United States Patent [19]

Scherer

[11] 4,250,865

[45] Feb. 17, 1981

[54] EASY ACCESS OVEN CONTROL PANEL AND PANEL SEAL

[75] Inventor: Richard M. Scherer, Oxford, Miss.

[73] Assignee: Chambers Corporation, Oxford, Miss.

[21] Appl. No.: 869,751

[22] Filed: Jan. 16, 1978

[51] Int. Cl.[3] ..... F24C 3/00; A74B 88/00

[52] U.S. Cl. ..... 126/41 D; 126/190; 308/3.6; 312/323

[58] Field of Search ..... 126/19 R, 273 A, 273 R, 126/41 D, 340, 190, 194, 41 E, 214 D, 139 K; 312/294, 313, 133, 302, 317 R, 322, 323; 361/391; 308/3.6

[56] References Cited

U.S. PATENT DOCUMENTS

| | | | |
|---|---|---|---|
| 2,327,541 | 8/1943 | Matheny | 126/190 X |
| 2,486,764 | 11/1949 | Singer | 175/298 |
| 2,649,085 | 8/1953 | Hurt | 126/41 D |
| 2,731,320 | 1/1956 | Belz | 312/323 |
| 2,789,024 | 4/1957 | Heisler | 312/333 |
| 2,856,450 | 10/1958 | Padgett et al. | 174/52 |
| 3,038,462 | 6/1962 | Hurko | 126/273 A X |
| 3,133,768 | 5/1964 | Klakovich | 308/3.6 |
| 3,172,994 | 1/1962 | Peay et al. | 219/393 |
| 3,702,112 | 11/1972 | Keppler | 126/19 R |
| 3,967,164 | 6/1976 | Valle | 317/114 |
| 4,077,389 | 3/1978 | Vogel | 126/190 |

*Primary Examiner*—Samuel Scott
*Assistant Examiner*—Randall L. Green
*Attorney, Agent, or Firm*—Richards, Harris & Medlock

[57] ABSTRACT

The specification discloses an electric oven control panel pivotally mounted on extensible arms. In an operational position, the control panel is supported flush against the oven with a gasket on the lower edge of the control panel engaging the front oven surface to prevent cooking fumes and gases from entering the control panel. In a service position, the control panel is pulled forward on the extensible arms away from the front oven surface and is rotated to a predetermined angle from its vertical position. Flanges on the panel engage the arms to limit rotation.

1 Claim, 4 Drawing Figures

EASY ACCESS OVEN CONTROL PANEL AND PANEL SEAL

FIELD OF INVENTION

The present invention relates to an improved oven control panel and in particular to an oven control panel pivotally mounted on improved extensible arms with limited rotation in an extended service position. A further aspect of the present invention relates to a control panel seal engaging the front oven surface to prevent cooking fumes and gases from entering the control panel area.

BACKGROUND OF THE INVENTION

Conventional electrical ovens normally provide a control panel containing control switches and devices, timers, and various indicators. To facilitate and simplify the repair and maintenance of these control devices, heretofore developed ovens have provided control panels pivotally mounted on extensible arms. A control panel mounted in this manner may be extended and rotated to provide servicemen with easy access to devices located in the panel. An example of such an accessible control panel is described in U.S. Pat. No. 3,967,164, issued June 29, 1976, and assigned to the present assignee. However, such prior panel mounting technique has been relatively expensive to manufacture due to the many parts involved, and have also sometimes required more maintenance than desirable. Furthermore, the design of many previously developed extensible oven control panels has been found undesirable in that it tended to encourage servicemen to apply their weight thereto for support, thereby causing damage to the extensible structure.

Typically, oven control panels have been mounted generally above the cooking chamber in the oven. It has been discovered that electrical devices in prior control panels are often not sufficiently isolated from their environment. Cooking fumes and grease laden gases tend to enter such control panels during normal oven operation and interfere with or damage electrical control devices contained therein. Thus, a need has arisen for an extensible oven control panel that sufficiently isolates control devices from the surrounding environment.

SUMMARY OF THE INVENTION

In accordance with an aspect of the present invention, an improved and inexpensive extensible arm for an accessible oven control panel is provided. The extensible arm of the present invention is formed of sheet metal with rectangular U-shape bends along the upper and lower edges of the arm. A pair of arms is mounted in a horizontal position directly on side interior vertical surfaces of a drawer cavity in the oven by loose fitting rearward and forward brackets that allow the arms to slide in a horizontal direction. Stops are formed on both ends of the arms with the rearward stop limiting the forward sliding of the arm. This construction results in an inexpensive, entirely suitable extensible arm for an oven control panel.

In accordance with another aspect of the present invention, the panel is mounted on support plates having bearing apertures which receive bearing rods. The rods are attached to the forward ends of two extensible arms. In an operational position, the panel is vertical mounted flush against the oven. In a service position the panel is pulled forward on the extensible arms and rotated approximately 55 degrees from its vertical position. Each end of the horizontal extensible arms is inclined inwardly from the top to the bottom edge at an angle of approximately 55 degrees from vertical. A limiting flange is provided extending from the control panel to engage the inclined end of the arm in a service position to limit rotation of the control panel to approximately 55 degrees from vertical. Electrical oven devices are mounted in the panel and are connected to a power terminal and a receptacle in the drawer cavity by electrical conductors. Such conductors have sufficient slack to allow unimpeded extension of the panel. In the service position with the panel rotated less than 90 degrees from vertical, preferably 55 degrees from vertical, it has been discovered that servicemen were less likely to damage the above described mechanisms for supporting the control panel and that the servicing of the oven was facilitated.

In accordance with another aspect of the present invention, an oven panel is secured in the operational position by panel flanges extending from the panel and releasably attached to oven flanges with sheet metal screws. A resilient elastic rubber gasket including a tube and a contact lip is mounted on the lower horizontal edge of the control panel with the contact lip facing and engaging the front surface of the oven when the panel is in an operational position. In this manner, cooking fumes and gases rising from the cooking chambers of the oven are prevented from entering the control panel and the drawer cavity behind the control panel. Thus, the electrical devices contained within the control panel are substantially isolated from their environment which results in a greater reliability and increased life expectancy for the devices.

BRIEF DESCRIPTION OF THE DRAWINGS

The advantages and further aspects of the present invention will be readily appreciated by those of ordinary skill in the art as the same becomes better understood by reference to the following detailed description when considered in connection with the accompanying drawings.

DESCRIPTION OF PREFERRED EMBODIMENT

Figure 1:
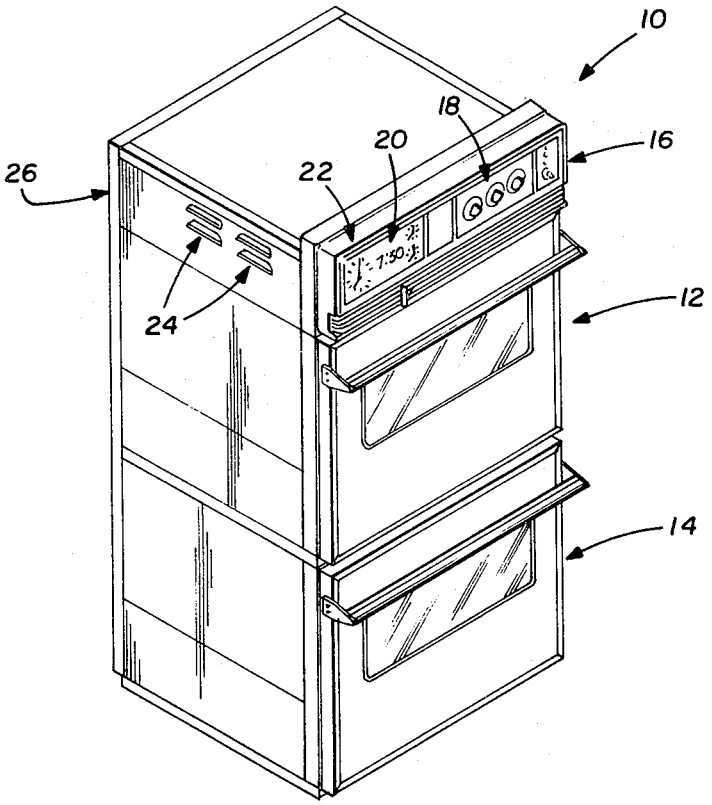
FIG. 1 illustrates a front perspective view of a double oven having the improved control panel of the present invention.

Referring now to the drawings, wherein like reference characters designate like or corresponding parts throughout several views, there is shown in FIG. 1 a double oven 10 with vertically spaced upper and lower oven cooking cavities 12 and 14, respectively, having electrical heating elements and doors for closing the ovens. The improved control panel 16 embodying the present invention is substantially rectangular in shape and is shown mounted above the upper oven cooking cavity 12. Control panel 16 includes control knobs and switches 18, a digital clock 20 and a conventional time indicator 22. Side vents 24 ventilate the drawer cavity 26 located directly behind control panel 16. It is to be understood that the position of control panel 16 and the associated drawer cavity 26 is shown above ovens 12 and 14 for illustration purposes only and that panel 16 may be positioned elsewhere in the double oven or may be used in a number of positions with a single oven or another type of electrical appliance requiring a control panel.

Figure 2:
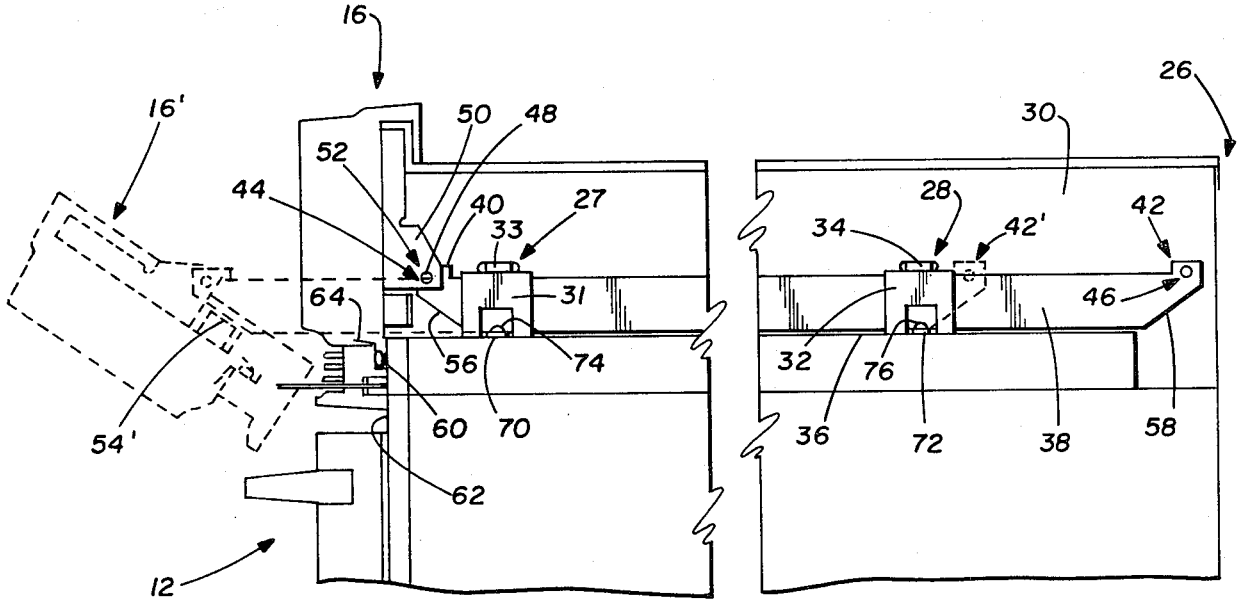
FIG. 2 illustrates a cross-section side view of the oven showing the control panel and extensible arms, the solid lines depicting the position of the panel in an operational position and the dotted lines depicting the panel in a service position.

Referring now to FIG. 2, a cross-sectional side view of cavity 26 and control panel 16 is shown. Slits 27 and 28 are formed in the side 30 of drawer cavity 26. Brackets 31 and 32 include tabs 33 and 34 which are inserted through slits 27 and 28, respectively, to secure the bracket to the sides 30. Brackets 31 and 32 are secured to the bottom surface 36 of cavity 26 by screws or bolts which fasten a tab extending from the brackets to surface 36. Extension arm 38 is loosely held and supported by brackets 31 and 32 allowing arm 38 to move horizontally within the brackets. Tolerances between the brackets and arm 38 should be large enough to allow arm 38 to move freely and yet small enough to insure stable support for the arm. Formed on the forward and rearward ends of arm 38 are stops 40 and 42, respectively. Rearward stop 42 limits the horizontal movement of arm 38 by engaging bracket 32. Stop 42 is shown in phantom lines as 42′ in a position engaging bracket 32. Aperture 44 is formed in the forward end of arm 38 and matching aperture 46 is formed in the rearward end. Both apertures are suitable for receiving a pivot rod such as rod 48 shown extending inwardly through aperture 44 at a right angle to arm 38.

Panel 16 is supported on extension arm 38 by a protruding plate portion 50 having a bearing aperture 52 which acts as a bearing on rod 48. In this manner, panel 16 is secured to extension arm 38 such that it may rotate about pivot rod 48. In FIG. 2 panel 16 is shown in phantom lines as panel 16′ in an extended and rotated position. Also shown in phantom is flange 54′ which extends from panel 16 and engages the inclined portion 56 of the forward end of arm 38. To place panel 16 in a service position, panel 16 is pulled forward away from the oven causing extension arm 38 to slide in brackets 33 and 34. Then panel 16 is rotated forward approximately 55 degrees from vertical until flange 54′ engages inclined portion 56. In this position, electrical devices and circuits mounted in panel 16 are accessible for service from the rear side of panel 16.

Also shown in FIG. 2 is a gasket 60 engaging the front surface 62 of the oven. Gasket 60 is attached to retainer flange 64 which is in turn attached to panel 16. Flange 64 is stair step shaped with the top flange portion being secured to panel 16. Gasket 60 is attached to the middle flange portion of flange 64 and partially rests on the bottom flange portion. When the panel 16 is in an operational position flush with the front of the oven, gasket 60 is pressed between flange 64 and oven surface 62 to form a seal which prevents gases and fumes emanating from oven 12 from entering panel 16 or drawer cavity 26.

Figure 3:
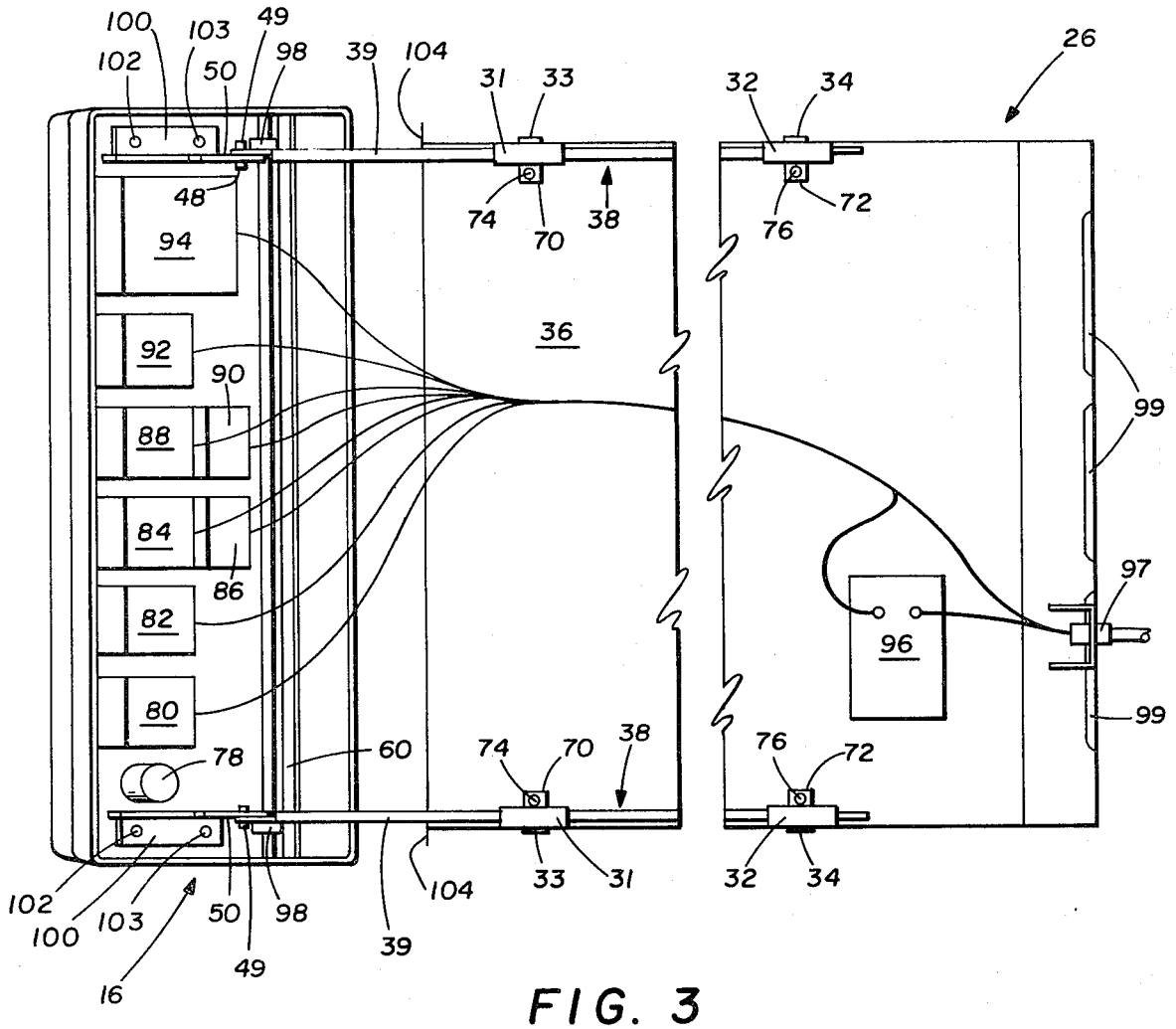
FIG. 3 illustrates a plan view of the oven and control panel in a service position.

Although FIG. 2 is a cross section view and depicts only one extensible arm 38, it is to be understood that two such arms are mounted on either side of the oven within the drawer cavity 26 as shown in FIG. 3. Thus, it is necessary to provide right and left extensible arms. It is apparent from the description above and the illustration of arm 38 in FIG. 2 that arm 38 is symmetrical with the opposing arm ends being mirror images of one another. The forward end includes stop 40 which is substantially identical to stop 42 on the rearward end. The rearward end includes aperture 46 which is substantially identical to aperture 44 in the forward end. Thus, it is seen that a right extensible arm may be transformed into a left extensible arm by placing the rearward end forward and positioning rod 48 through aperture 46 instead of aperture 44. The interchangeability of right and left extension arms results in economical manufacture and oven assembly.

Referring now to FIG. 3, tabs 70 and 72 are shown extending from brackets 31 and 32, respectively, with the tabs being secured to surface 36 by means of screws 74 and 76. Tabs 33 and 34 may be seen on the outside surface of the oven securing brackets 31 and 32, respectively, to the side walls of the oven. In FIG. 3 the control panel 16 is shown in a service position. The panel has been extended forward and rotated 55 degrees from vertical. In this position it is apparent that access may be easily gained to the rear side of panel 16 such that the control instruments and devices mounted in panel 16 may be serviced. Such instruments and devices mounted in panel 16 include lightswitch 78, upper oven thermostat 80, selector switch 82, lower oven thermostat 84, lock relay and junction block 86, thermal relay 88, thermal cycler 90, clock switches 92, and digital clock 94. Each of the above-mentioned devices is electrically connected to corresponding oven devices by electrical conductors extending from control panel 16 and having sufficient slack to allow the panel to slide forward on extension arms 38 and to freely rotate about pivot rods 48. Power is supplied to the control panel through power terminal 96. Electrical connections with other parts of the oven and an outside power source are made through receptacle 97, and vents 99 are provided on the rear wall of drawer cavity 26 for ventilation.

In the plan view shown in FIG. 3, the pivotal mounting system is clearly shown. Pivot rod 48 includes a base 49 which is welded to arm 38 after rod 48 has been positioned extending through aperture 44. The pivot rod 48 extends from extension rods 38 through support plate portion 50 and out the other side. It is acceptable but not necessary to place a nut or other fastener on the interior end of rod 48 to secure the rod in position. The upper and lower edges 39 of arms 38 include U-shape bends extending along the length of arms 38 to provide strength and resistance to bending. The rigidity of arm 38 and plate portion 50 serves to maintain the proper position of rods 48. Also shown in FIG. 3 are panel flanges 100 on panel 16 positioned above support plates 50. Flanges 100 are removably attached to oven flanges 104 to secure panel 16 in an operational position. Flanges 104 are provided on the front surface of the oven having apertures aligned with apertures 102 and 103 in flange 100. Sheet metal screws, bolts or the like extending through apertures 102 and 103 and the corresponding apertures in flanges 104 are used to secure panel 16 to the front surface of oven for placing and securing the panel in an operational position.

In the service position as shown in FIG. 3, gasket 60 is disengaged from the front surface of the oven. When panel 16 is rotated to an upright position and moved horizontally back into the operational position, gasket 60 will engage the front surface of the oven to form a seal and to prevent gases and cooking fumes from entering door cavity 26 and control panel 16.

Figure 4:
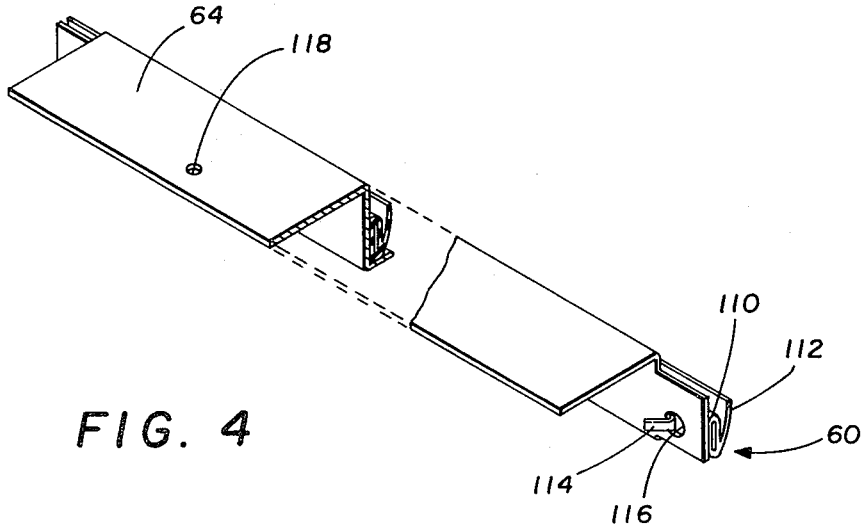
FIG. 4 illustrates a perspective cut away view of the control panel gasket and gasket retainer flange.

FIG. 4 depicts a detailed illustration of gasket 60 and gasket retaining flange 64. Gasket 60 consists of a tube 110 having an oval cross section. Extending from the bottom edge of tube 110 is a contact lip 112 which extends upward in a vertical direction beyond the top edge of tube 110. The gasket is constructed of a soft rubber material sufficiently flexible to form a tight seal against the oven and yet sufficiently heat resistant to withstand the temperatures normally associated with oven use. The tube 110 and the lip portion 112 may be constructed separately and attached to one another with an adhesive, but it is preferred to use a gasket in which tube 110 and lip 112 are formed of a continuous piece of rubber.

Gasket 60 is attached to flange 64 by hooks 114. Hooks 114 may be attached to gasket 60 in a number of ways such as with an adhesive, brads or clamps, but in the preferred mode one end of hook 114 is anchored using an adhesive within tube 110 and the other end of the hook engages apertures 116 which are formed on either end of flange 64. Hooks 114 are attached to tube 110 such that the gasket must be stretched to allow hooks 114 to engage holes 116 on either end of flange 64. In this manner, tension is created in gasket 60 which clamps hooks 114 in position and securely fastens gasket 60 on flange 64. To provide such tension, gasket 60 must be constructed of a flexible, elastic and resilient rubber that maintains these characteristics at temperatures normally associated with oven use. Apertures 118 are formed in the top portion of flange 64. Sheet metal screws are disposed through apertures 118 to attached flange 64 to panel 16. A bottom portion of flange 64 is positioned below gasket 60 to provide the gasket with vertical support. In this manner the gasket is securely fastened on panel 16 by means of flange 64 and is positioned to engage the front surface of oven 10.

Having thus fully described the preferred embodiment of the present invention, certain alterations of the invention will be apparent to those of ordinary skill in the art. It is to be understood that the present invention includes such alterations as fall within the scope of the appended claim.

What is claimed is:

1. In an oven cabinet having front, rear and side walls in which a control panel is supported flush against the front wall thereof, apparatus to facilitate servicing of the backside of the control panel comprising:

a pair of supporting brackets disposed on the inside surface of said cabinet on opposite side walls thereof in substantially parallel relation;

a pair of arms slidably mounted in said brackets and capable of being extended from the cabinet to any selected horizontal position, said arms having forward and rearward ends, a stop means extending from the rearward end for engaging said brackets to limit horizontal movement of said arms, the forward end being configured to define an abutment surface inclined to the vertical;

an oven control panel pivotally connected to each of said arms and being pivotable from a vertical operational position to an inclined service position when said control panel has been extended from said cabinet to a selected horizontal position, the backside of said control panel abutting with the inclined abutment surface on the forward ends of said arms when said arms are extended and when said panel is in service position for positioning said control panel at an angle from the vertical;

a flexible gasket disposed along the lower horizontal edge of said control panel adapted to be compressed by said control panel against the front surface of the cabinet to prevent cooking fumes and gases from the oven cavity from entering along the lower edge of the control panel; a gasket retaining flange having a top flange portion attached to the lower edge of the control panel;

said gasket including a resilient tube having an oval cross-section and being attached to said flange;

a resilient contact lip formed along the length of said tube extending upwardly from a lower edge thereof, said lip making contact with the front surface of the cabinet when said panel is disposed in its operational position to form an airtight seal between the seal and the cabinet.

* * * * *